US006971349B2

(12) United States Patent
Burch et al.

(10) Patent No.: US 6,971,349 B2
(45) Date of Patent: Dec. 6, 2005

(54) INTEGRATED SOLENOID BOARD AND CAM LADDER

(75) Inventors: Craig E. Burch, West Bloomfield, MI (US); Deborah M. Bjorge, Royal Oak, MI (US); Kim Ku, West Bloomfield, MI (US); Mark Alan Zagata, Livonia, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 102 days.

(21) Appl. No.: 10/064,842

(22) Filed: Aug. 22, 2002

(65) Prior Publication Data

US 2004/0035381 A1 Feb. 26, 2004

(51) Int. Cl.[7] ..... F01L 1/34

(52) U.S. Cl. ..... 123/90.16; 123/90.31; 123/90.39

(58) Field of Search ..... 123/90.16, 90.44, 123/90.31, 90.39, 90.41; 74/559

(56) References Cited

U.S. PATENT DOCUMENTS 4,615,306 A 10/1986 Wakeman
4,823,747 A * 4/1989 Wagner et al. ..... 123/193.5
5,003,933 A 4/1991 Rush, II et al.
5,035,637 A 7/1991 Mathews et al.
5,189,782 A 3/1993 Hickey
5,449,227 A 9/1995 Steinberg et al.
5,515,905 A 5/1996 Lester
5,524,580 A 6/1996 Muir
5,544,626 A 8/1996 Diggs et al.
5,623,897 A 4/1997 Hampton et al.
5,682,848 A * 11/1997 Hampton et al. ..... 123/90.16
5,690,066 A 11/1997 Hampton et al.
6,186,106 B1 2/2001 Glovatsky et al.
6,250,335 B1 6/2001 Ohishi et al.
6,318,318 B1 11/2001 Jahr
6,405,693 B2 * 6/2002 Yoeda et al. ..... 123/90.15
6,591,798 B2 * 7/2003 Hendriksma et al. .... 123/90.16

* cited by examiner

*Primary Examiner*—Thomas Denion
*Assistant Examiner*—Zelalem Eshete
(74) *Attorney, Agent, or Firm*—Gary Smith

(57) ABSTRACT

An internal combustion engine cylinder head camshaft bearing ladder 210, is provided which includes a first body with an aperture to facilitate threaded connection 202 of the body to a cylinder head 2 with a cut out 212 for receiving a cam shaft 67, the first body also having a pocket 218, and a solenoid actuator 220 positioned within the pocket 218 for activating a switchable rocker arm assembly 9.

24 Claims, 3 Drawing Sheets

INTEGRATED SOLENOID BOARD AND CAM LADDER

BACKGROUND OF INVENTION

The field of the present invention is an internal combustion engine having dual mode operational rocker arm assemblies.

Internal combustion engine rocker arms transmit motion from a rotating cam shaft to a stem of a poppet valve to open and close the valve.

In recent times, rocker arms have been made to selectively totally or partially deactivate to allow enhanced control of vehicle engines in regard to emissions and fuel economy. Such rocker arms are referred to as dual mode operational or switchable rocker arms.

To selectively switch the mode of operation of the rocker arm assembly there is provided a pivotal lever actuated by a solenoid actuator.

Two of the major factors which has discouraged the use of dual mode operational rocker arm assemblies are the cost associated therewith and the manufacturing tolerances required. It is desirable to provide an apparatus and method of placement of the solenoids associated with dual operational mode rocker arms that improve dimensional placement of the solenoids thereby minimizing manufacturing tolerance variability. It is also desirable to provide solenoid placement for the rocker arm assembly that can minimize required assembly time and enhance operational reliability of the solenoid actuator system.

SUMMARY OF INVENTION

The present invention provides an engine which includes a combustion chamber and a cylinder head with inlet and exhaust passageways fluidly connected with the combustion chamber. Controlling flow through the inlet and exhaust passageways are first and second valves. First and second rocker arms are provided for actuating the first and second valves respectfully. The rocker arms have multiple modes of operation. First and second cam shafts are provided which are rotatably connected to the cylinder head by a bearing cap ladder. First and second solenoid actuators are provided within pockets of the bearing cap ladder for actuating the rocker arms between their multiple modes of operation. The solenoid actuators are electrically connected via a printed circuit board.

It is an advantage of the present invention to provide an internal combustion engine which has dual mode rocker arm assemblies wherein the solenoid actuators for such solenoid assemblies can be installed in the engine by installation of the bearing cap ladder.

It is an advantage of the present invention to provide an internal combustion engine as noted above which additionally can cause the wiring required for powering the solenoids to be installed upon assembly of the cam shaft bearing cap ladder.

Other features and advantages of various embodiments of the present invention will become more apparent to those skilled in the art from a reading of the following detailed description and upon reference to the drawings.

DETAILED DESCRIPTION

Figure 1:
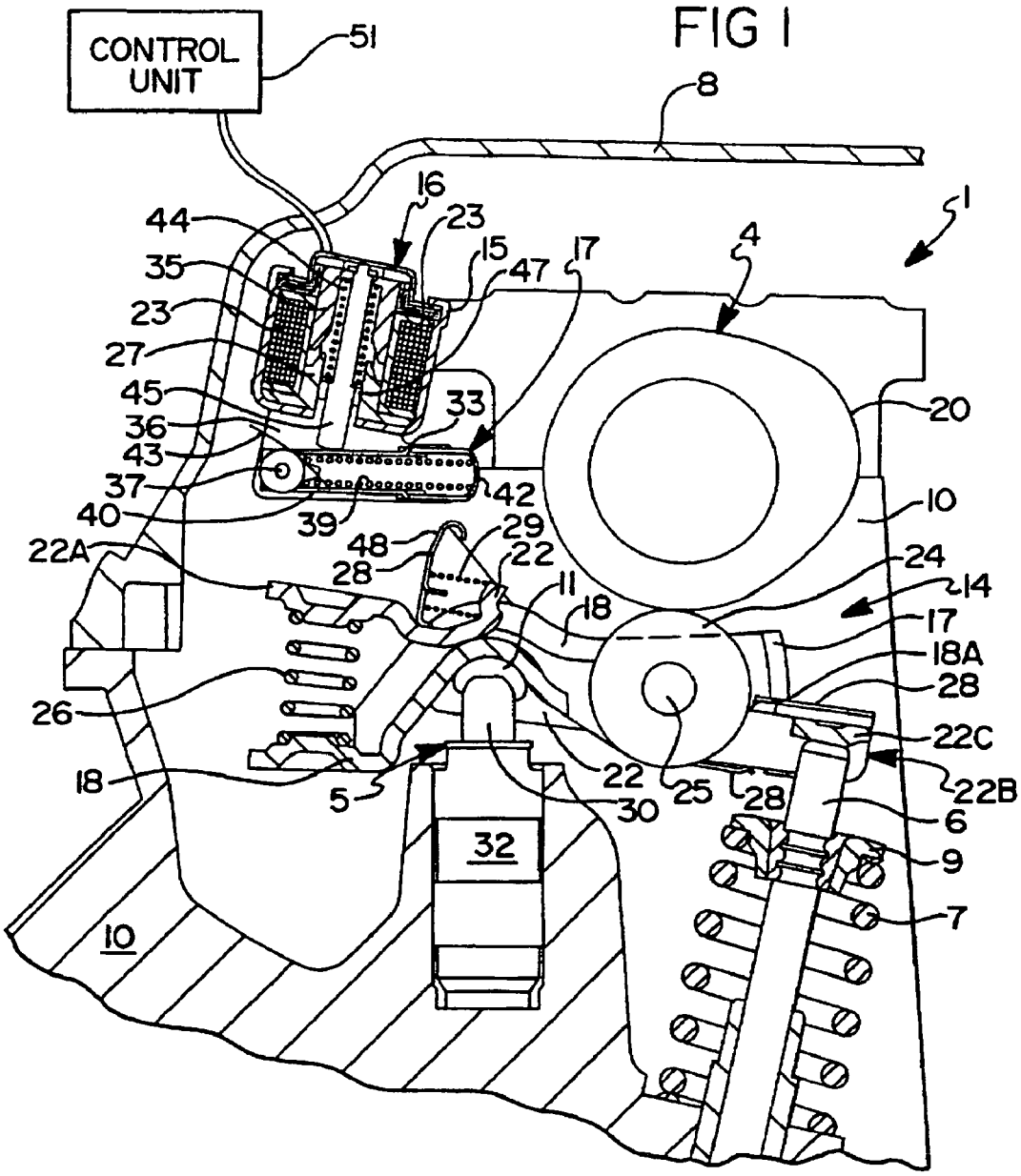
FIG. 1 is a top perspective view of a rocker arm assembly which can be utilized in a preferred embodiment internal combustion engine of the present invention.
Figure 2:
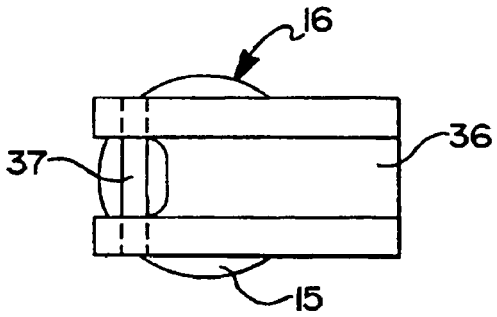
FIG. 2 is a sectional view taken along lines 2—2 of FIG. 1 with a rocker arm assembly lost motion arm nearly at its uppermost angular position.
Figure 3:
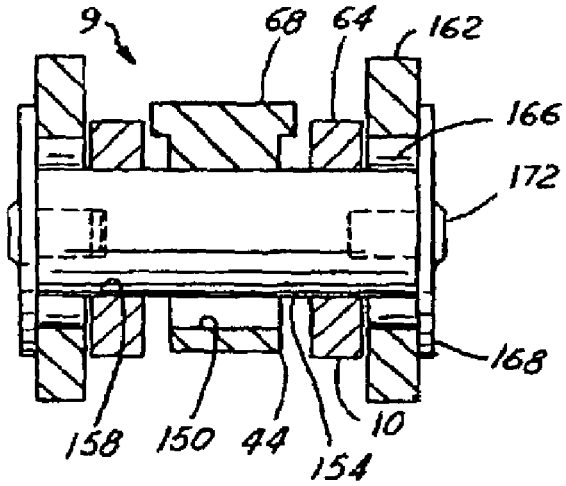
FIG. 3 is a view taken along lines 3—3 of FIG. 1 with a lost motion rocker arm of the rocker arm assembly moved to its lowermost angular position for purposes of illustration.
Figure 5:
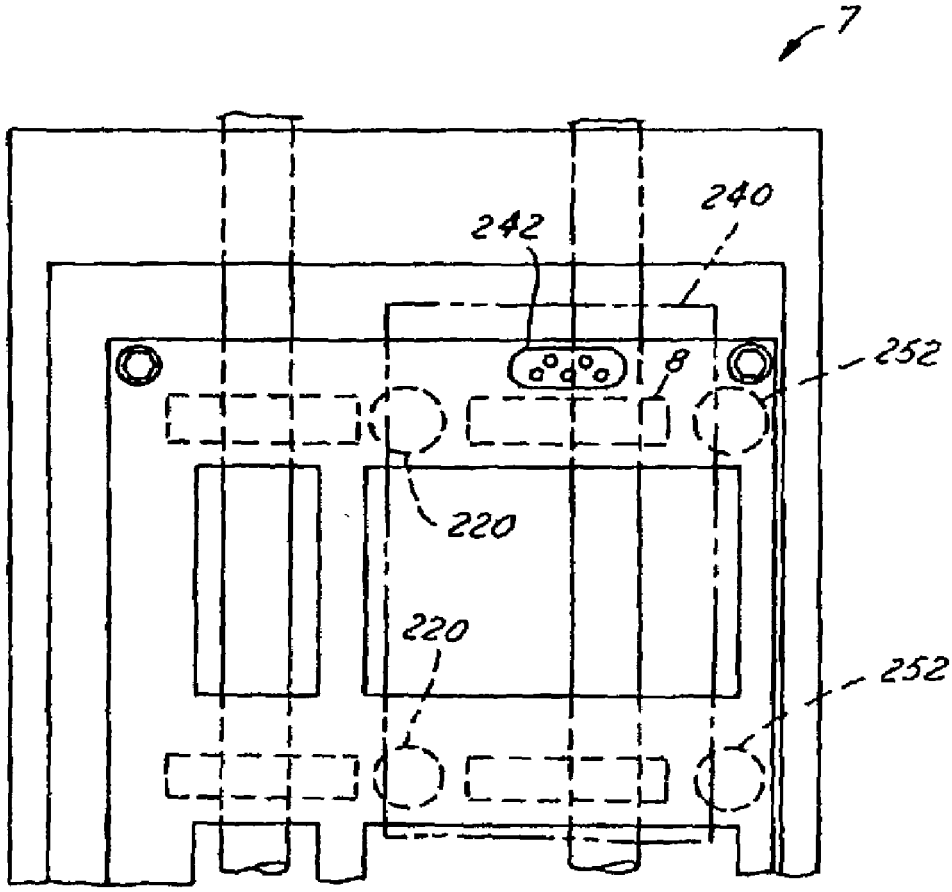
FIG. 5 is a schematic top elevational view of the internal combustion engine shown in FIG. 4.

FIGS. 1 through 5 illustrate an internal combustion engine 7 and various components associated therewith according to the present invention. The engine 2 has a cylinder head 2. The cylinder head 2 is covered by a cam cover 3. The engine 7 has exhaust and intake exhaust rocker arm assemblies 8 and 9. The rocker arm assembly 9 has a forked-shaped body 10 which is often referred to as a cradle or outer arm. The body has twin ears 12 (FIG. 2). The ears 12 have a transverse bore 13. The rocker arm body 10 has a first end 14. The rocker arm body first end 14 as best shown in FIG. 2 engages with a valve stem 18 via a convex contact surface 15 (only partially shown) to activate a poppet valve 19. The valve stem 18 is biased generally upward by a spring 22 which is captured by a valve stem collar 26.

The engine head 2 has an exhaust air passageway 27 fluidly connected with a combustion chamber 31 via a port provided by a valve seat not shown). The valve 19 controls fluid communication between passageway 27 and combustion chamber 31. The upward biasing of the valve stem 18 places the valve 19 in a closed position, the valve 19 in the closed position prevents fluid communication into the exhaust passageway 27 from the combustion chamber 31 of the engine. To open the poppet valve 19, the body first end 14 will pivot in a generally counter-clockwise direction.

The body 10 has an opposite second end 30. The second end 30 engages with a pivot fulcrum 48. The pivot fulcrum 48 is provided by a plunger portion 52 of a hydraulic lash adjuster 54. The body second end 30 has a spherical socket receiving the plunger 52. The lash adjuster 54 constitutes a stationary fulcrum for pivotal movement of the body 10 of the rocker arm assembly in a manner to be described.

An inner or lost motion arm 44 is pivotally connected to the first end 14 of the body 10. A pin 34 passes through the bore 13 and a corresponding bore in the lost motion arm 44. A lever end 42 of the lost motion arm is pivotally connected by the pin 34. The lost motion arm 44 fits in between fork-like lobes 64 of the body.

The lost motion arm 44 is spring biased arcuately in a counter-clockwise direction as shown in FIG. 2 to have contact with a rotatable cam lobe 66. The cam lobe 66 is rotated by a camshaft 67 that is powered by the engine. To make contact with the cam lobe 66, the lost motion arm 44 has a contact pad 68. The camshaft has a rotational radius 69. The contact pad has an axis of curvature at point 99 which is intersected by a line 101. In an embodiment (not shown), the lost motion arm 44 can have a rotatively connected roller instead of a contact pad. The lost motion arm 44 is spring biased into the cam lobe 66 by coil torsion springs 80. The coil torsion springs 80 have a first leg 83 which pushes against the body 10. The springs 80 have a second leg 84 which interacts with the lost motion arm 44 to urge it in a counter-clockwise direction. The springs 80 encircle the pin 34 and are mounted on the dual heads 90 of the pin. The heads 90 are held in position on the pin 34 by a retention washer 94.

The second end 30 of the body 10 also has a latch mechanism. The latch mechanism includes an extendable plunger 120. The plunger 120 has an upper first contact surface 124. The plunger 120 also has a transverse bore 128 to allow for the cumulative flow of lubricating oil therethrough. The plunger 120, as shown in FIG. 2, has an extended (leftward) first position wherein its first contact surface 124 makes contact with a first contact surface 102 of the lost motion arm 44. In the first position, the plunger 120 prevents relative angular motion of the lost motion arm 44 with respect to the body 10 in a clockwise direction. The plunger 120, as best shown in FIG. 2, has a second position which is non-contacting with the lost motion arm 44 to allow the lost motion arm 44 to pivot clockwise relative to the body 10.

The plunger 120 has fixably connected thereto a latch pin 134. A spring 136 encircles the plunger 120 in its position within a bore of the body 10. The spring 136 urges the latch pin 134 to the right, as shown in FIG. 2, to position the plunger 120 in its aforementioned second position. The plunger 120 is held to the body 10 by a latch pin retainer 142 that clips onto a transverse ledge 148 of the body 10 (FIG. 1).

The lost motion arm 44 of the rocker arm has an aperture 150 transversely extending therethrough. Extending through the aperture is a shaft 154. The shaft 154 is press-fitted through aligned apertures 158 provided in the lobes 64 of the body. Mounted on the shaft 154 are rollers 162 that rotatably connect with the body 10. The rollers 162 are mounted on the shaft 154 by needle bearings 166. The needle bearings 166 are held in position by a cover 168. The cover 168 is connected with the shaft 154 by a pin 172.

Figure 4:
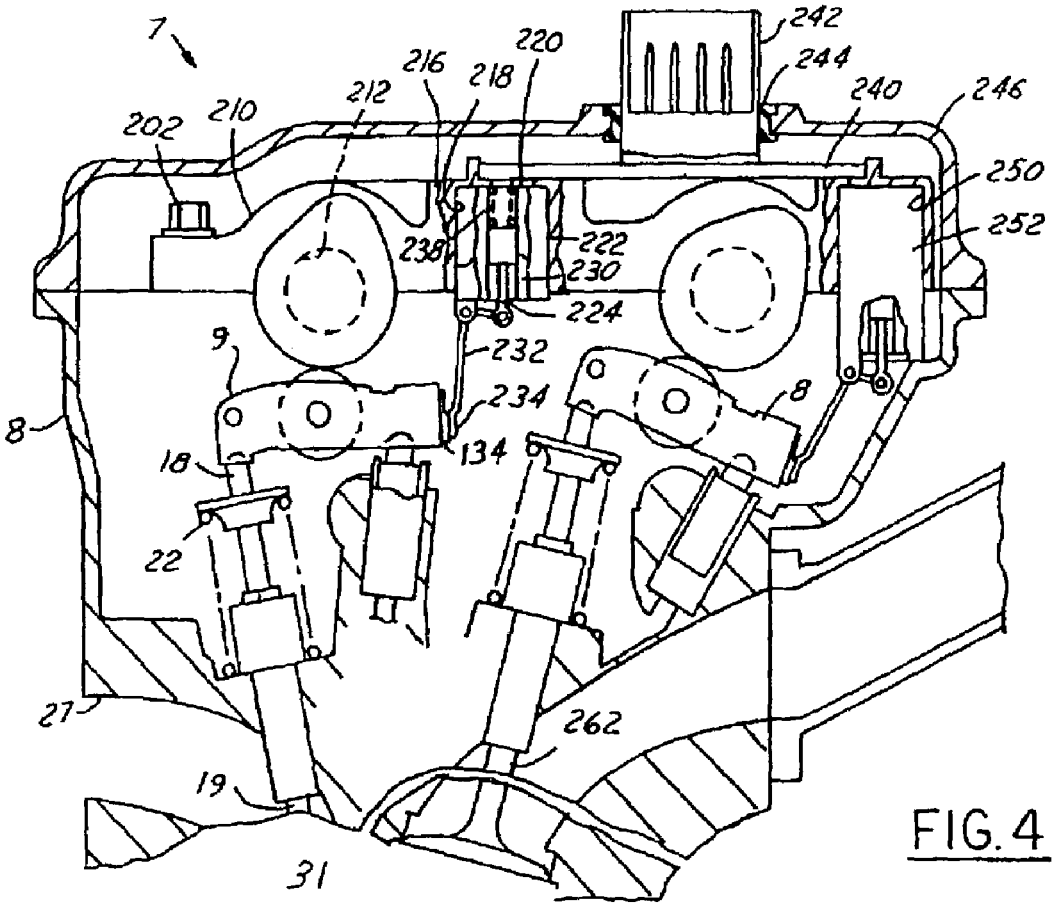
FIG. 4 is a sectional view of an internal combustion engine according to the present invention which utilizes the rocker arm assembly shown in FIGS. 1–3.

Referring in more detail to FIG. 4, fixably connected to the cylinder head 2 by a bolt 202 is a cam shaft bearing cap ladder 210. The bearing cap ladder 210 has a drilled out half bore cut out 212. The bore 212 mounts a cam shaft bearing (not shown) which rotatably connects or mounts the cam shaft 67 with the cylinder head 2. The body 216 of the bearing cap ladder 210 has a series of pockets 218. A solenoid actuator 220 is fixably connected with the bearing cap ladder 210 and is encapsulated within the pocket 218 by a polymeric material such as an epoxy resin 222. The solenoid actuator 220 has a plunger shaft 224. The plunger shaft 224 is surrounded by actuating coils 230. The plunger shaft 224 is pivotally connected with an inverted L-shape lever arm 232. The L-shape lever arm 232 has a hammerhead 234. The hammerhead 234 engages or disengages the latch pin 134. The hammerhead 234 makes contact with the cylindrical surface 144 of the latch pin 134. The hammerhead 234 is urged into an engagement with the latch pin due to a solenoid biasing spring 238.

When it is desirable for the plunger 120 to assume its second position shown in FIG. 2, the engine control unit will supply power to the activated solenoid actuator 220 to cause the arm 232 to rotate away from the latch pin 134 to allow the rocker arm latch spring 136 to move the plunger 120 to its second position.

The solenoid 220 has leads provided in a printed circuit board 240 provided in the bearing cap ladder 210. The printed circuit board 240 is connected with a pass through connector 242. The pass through connector 242 extends through a rubber grommet 244 provided in a cam cover 246. The cam cover is threadably connected with the cylinder head 2 by fasteners (not shown). The circuit board 240 strengthens the bearing cap ladder 210 and also sealably encases the leads for the solenoid actuators 220 and 252. The cam cover 246 is connected with the cylinder head 2 by threaded fasteners (not shown).

The cam shaft bearing cap ladder has laterally aligned pockets 218 to receive other solenoid actuators for the other exhaust rocker arm assemblies 9. Additionally the body 216 of the cam ladder has a pocket 250 for reception of the solenoid actuator 252 which controls an intake rocker arm assembly 8 which is utilize for the intake valve 262. The cap bearing ladder 210 additionally has other pockets for the solenoids of the other intake valves for the other combustion chambers of the engine.

The rocker arm assemblies 9 have generally five (5) points of contact. The first point of contact is between the solenoid actuator lever hammer head 234 and the plunger 120. The second point of contact is between the latch adjuster 54, pivot fulcrum 48 and the outer body 10 of the lever arm assembly 9. The third point of contact is between the latch pin plunger 120 and the floating lost motion arm 44 of the rocker arm assembly. A fourth point of contact is between the cam shaft lobe 66 and the roller or sliding pad 68 of lost motion floating control arm of the rocker arm assembly. The last point of contact is between the outer body 10 of the rocker arm assembly and the valve stem 19.

The engine 7 of the present invention has several advantages. The first advantage is that the solenoids and all wiring associated therewith can be installed upon installation of the bearing cap ladder body 210. The installation is extremely accurate since the solenoids 220 and 252 are connected to the bearing cap ladder and encased in pockets therein. The leads to power the solenoids 220 and 252 are encased within the printed circuit board 240 and are therefore protected from dirt and other contaminants of the engine lubricating oil.

Although an embodiment of the present invention has been shown, it will be apparent to those skilled in the art of the various modifications that can be made without departing from the present invention as it is encompassed by the following claims.

What is claimed is:

1. An internal combustion engine cylinder head camshaft bearing ladder, comprising:

a first body with an aperture to facilitate threaded connection of said body to a cylinder head with a cut out for receivingly mounting a cam shaft, said first body also having a pocket; and a solenoid actuator positioned within said pocket for activating a switchable rocker arm assembly.

2. A camshaft bearing ladder as described in claim 1, having connected thereto a plurality of solenoid actuators.

3. A camshaft bearing ladder as described in claim 1, having a plurality of cut outs for reception of a plurality of cam shafts.

4. A camshaft bearing ladder as described in claim 2, wherein said solenoid actuator is encapsulated within said camshaft bearing ladder pocket by a polymeric material.

5. A camshaft bearing ladder as described in claim 1, wherein said solenoid actuator has leads connected with an integrated circuit board.

6. A camshaft bearing ladder as described in claim 5, wherein said circuit board is sealably connected with a pass through connector.

7. A camshaft bearing ladder assembly as described in claim 6, having at least a second solenoid actuator for a second rocker arm and wherein said second solenoid actuator has leads sealably connected with said integrated circuit board.

8. A method of assembling a portion of a solenoid actuator to a dual operational rocker arm assembly, comprising:

connecting a solenoid actuator in a pocket of a camshaft bearing ladder which receivingly mounts a camshaft; and connecting said camshaft bearing ladder with a cylinder head thereby positioning said solenoid actuator adjacent said rocker arm assembly.

9. A method as described in claim 8, further including encapsulating said solenoid actuator within said camshaft bearing ladder pocket with a polymeric material.

10. A method as described in claim 9, wherein said polymeric material is an epoxy resin.

11. A method as described in claim 9, further including connecting leads of said solenoid actuator with an encapsulated circuit board.

12. A method as described in claim 11, further including connecting said circuit board with a pass through connector.

13. An internal combustion engine comprising:

a combustion chamber;

a head with a passageway fluidly connected with said chamber;

a valve controlling fluid communication between said chamber and said passageway;

a cam shaft rotatably mounted on said head by a camshaft bearing cap ladder, said ladder having a pocket formed therein;

a rocker arm for actuating said valve, said rocker arm having first and second modes of operation of said valve; and a solenoid actuator for actuating said rocker arm between said first and second modes of operation, said solenoid actuator being connected with said bearing cap ladder within said pocket.

14. An internal combustion engine as described in claim 13, wherein said bearing cap ladder is connected with a second solenoid which actuates a second rocker arm assembly.

15. An internal combustion engine as described in claim 14, wherein said second solenoid actuates a rocker arm which is actuated by a second cam shaft rotatably mounted on said head.

16. An internal combustion engine as described in claim 14 wherein said second solenoid actuates a rocker arm assembly actuated by a cam shaft common with the other rocker arm assembly.

17. An internal combustion engine as described in claim 14, wherein said solenoid has leads provided by a printed circuit board connected with said bearing cap ladder.

18. An internal combustion engine as described in claim 17, wherein said printed circuit board is connected with a pass through connector.

19. An internal combustion engine as described in claim 18, wherein said pass through connector passes through a cam cover connected with said head.

20. An internal combustion engine, comprising:

a combustion chamber;

a head with an air passageway fluidly connected with said chamber;

first and second air passageways fluidly connected with said chamber;

first and second valves controlling fluid communication between said chamber and said respective first and second passageways;

first and second rocker arm for actuating said first and second valves respectively, said rocker arm having first and second modes of operation;

first and second cam shafts rotatably connected to said head by a bearing cap ladder;

first and second solenoid actuators for actuating said rocker arms between said first and second modes of operation, said solenoid actuators being connected in packets of said bearing cap ladder;

integrated circuit boards with leads sealably connected with said solenoids;

a pass through connector connected with said leads of said integrated circuit board; and a camshaft bearing cap cover penetrated by said pass through connector to allow for electrical connection to said solenoids.

21. An internal combustion engine cylinder head camshaft bearing ladder, comprising:

a first body with an aperture to facilitate threaded connection of said body to a cylinder head with at least two cut outs for receivingly mounting a camshaft on a side of said cam shaft generally opposite a combustion chamber of said engine, said first body also having a pocket; and a solenoid actuator positioned within said pocket for activating a switchable rocker arm assembly.

22. A method of assembling a portion of a solenoid actuator to a dual operational rocker arm assembly, comprising:

connecting a solenoid actuator in a pocket of a camshaft bearing ladder which receivingly mounts a camshaft on a side of said camshaft generally opposite a combustion chamber of an internal combustion engine; and connecting said camshaft bearing ladder with a cylinder head thereby positioning said solenoid actuator adjacent said rocker arm assembly.

23. An internal combustion engine comprising:

a combustion chamber;

a head with a passageway fluidly connected with said chamber;

a valve controlling fluid communication between said chamber and said passageway;

a camshaft rotatably mounted on said head on a side of said camshaft generally opposite said combustion chamber by a camshaft bearing cap ladder, said ladder having a pocket formed therein;

a rocker arm for actuating said valve, said rocker arm having first and second modes of operation of said valve; and a solenoid actuator for actuating said rocker arm between said first and second modes of operation, said solenoid actuator being connected with said bearing cap ladder within said pocket.

24. An internal combustion engine, comprising:

a combustion chamber;

a head with an air passageway fluidly connected with said chamber;

first and second air passageways fluidly connected with said chamber;

first and second valves controlling fluid communication between said chamber and said respective first and second passageways;

first and second rocker arm for actuating said first and second valves respectively, said rocker arms having first and second modes of operation;

first and second camshafts rotatably connected to said head by a bearing cap ladder on a side of said camshafts generally opposite said combustion chambers;

first and second solenoid actuators for actuating said rocker arms between said first and second modes of operation, said solenoid actuators being connected in pockets of said bearing cap ladder;

integrated circuit boards with leads sealably connected with said solenoids;

a pass through connector connected with said leads of said integrated circuit board; and a camshaft bearing cap cover penetrated by said pass through connector to allow for electrical connection to said solenoids.

* * * * *